US007914289B1

(12) United States Patent
Haley

(10) Patent No.: US 7,914,289 B1
(45) Date of Patent: Mar. 29, 2011

(54) SYSTEM AND METHOD FOR GOLF INSTRUCTION

(76) Inventor: James Keith Haley, Hilliard, OH (US)

( * ) Notice: Subject to any disclaimer, the term of this patent is extended or adjusted under 35 U.S.C. 154(b) by 620 days.

(21) Appl. No.: 11/971,026

(22) Filed: Jan. 8, 2008

Related U.S. Application Data

(60) Provisional application No. 60/884,103, filed on Jan. 9, 2007.

(51) Int. Cl.
*A63B 69/36* (2006.01)

(52) U.S. Cl. ..... 434/252

(58) Field of Classification Search ..... 434/247, 434/252, 258; 473/226, 227, 231, 238, 242, 473/256, 266, 268
See application file for complete search history.

(56) References Cited

U.S. PATENT DOCUMENTS

| | | | | | |
|---|---|---|---|---|---|
| 3,111,322 | A | | 11/1963 | English | |
| 3,351,346 | A | | 11/1967 | Strahan | |
| 3,874,660 | A | * | 4/1975 | Brethen | 482/109 |
| 4,249,762 | A | * | 2/1981 | Richards | 473/256 |
| 4,506,885 | A | * | 3/1985 | de Wet | 482/110 |
| 4,569,525 | A | * | 2/1986 | Folger | 473/242 |
| 5,042,811 | A | | 8/1991 | D'amico | |
| 5,100,148 | A | * | 3/1992 | Smith | 473/228 |
| 5,121,925 | A | * | 6/1992 | Blundo | 473/242 |
| 5,174,567 | A | * | 12/1992 | Nordstrom | 473/446 |
| 5,199,713 | A | * | 4/1993 | Kinoshita | 473/242 |
| 5,228,695 | A | * | 7/1993 | Meyer | 473/238 |
| 5,310,188 | A | * | 5/1994 | Hernberg | 473/206 |
| 5,362,059 | A | * | 11/1994 | Grossman | 473/228 |
| 5,527,039 | A | * | 6/1996 | Levesque | 473/226 |
| D428,461 | S | * | 7/2000 | Koszalinski | D21/791 |
| 6,293,875 | B1 | * | 9/2001 | Sanford | 473/268 |
| 6,719,639 | B2 | | 4/2004 | Novosel, Sr. | |
| 7,048,638 | B2 | | 5/2006 | Novotny | |
| 7,416,492 | B2 | * | 8/2008 | Wesley | 473/226 |
| 7,524,247 | B2 | * | 4/2009 | Williams | 473/223 |
| 7,625,295 | B2 | * | 12/2009 | Gutierrez | 473/256 |

OTHER PUBLICATIONS www.medicus.com, Jan. 8, 2008, Medicus swingtrainers.
www.momentusgolf.com, Jan. 8, 2008, momentus swing trainer.
www.refinergolf.com, refiner golf swing trainer, Jan. 8, 2008.
www.golfaroundtheworld.com, Jan. 8, 2008, golf around the world swing trainers.
www.swingsetter.com, Leadbetter Swing Setter, Jan. 8, 2008.
www.rovergolf.com, Power Angle Pro Ultimate Swing Trainer, Jan. 8, 2008.
Amazing Assist Swing Trainer, www.matzie.com, Jan. 8, 2008.
Cast-Away Power Trainer, www.matzie.com, Jan. 8, 2008.

* cited by examiner

*Primary Examiner* — Kurt Fernstrom
(74) *Attorney, Agent, or Firm* — Ronald J. Koch

(57) ABSTRACT

An apparatus for golf instruction comprising: a weight bar 3; a grip section 2; and an overlay decal 10; the weight bar having distinct color regions about the periphery thereof; the weight bar and grip sections being elongated and rigid; the grip section and weight bar being substantially perpendicular to each other.

2 Claims, 6 Drawing Sheets

FIG. 1
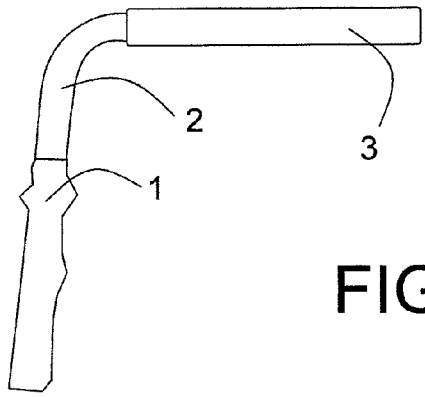
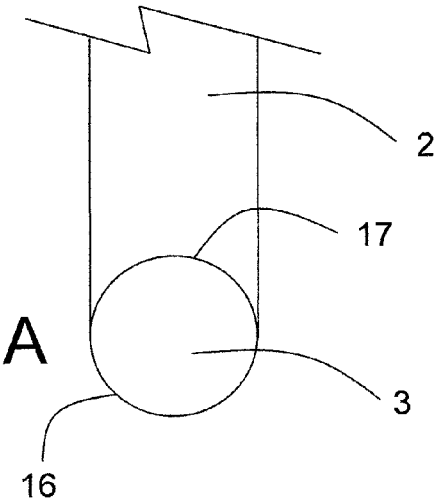
FIG. 1A
FIG. 2
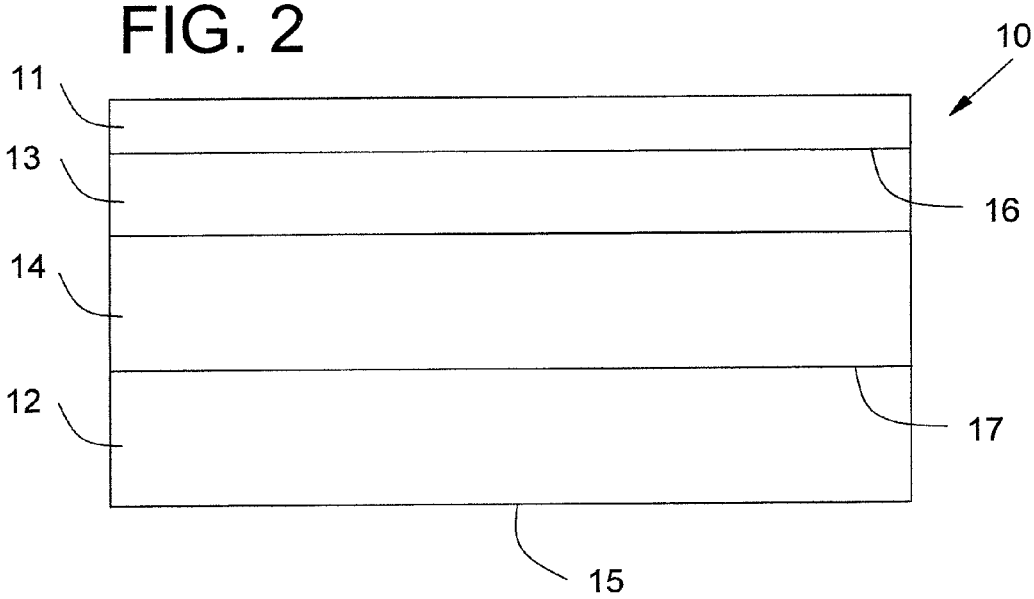

(front view)

22A (side view)

22A (top view)

SYSTEM AND METHOD FOR GOLF INSTRUCTION

The present application is related to the co-pending provisional patent application No. 60/884,103 of James Keith Haley filed Jan. 9, 2007, entitled "System And Method For Golf Instruction", and based on which priority is herewith claimed under 35 U.S.C. 119(e) and the disclosure of which is incorporated herein by reference in its entirety as if fully rewritten herein.

BACKGROUND AND SUMMARY

The present invention relates to golf instruction and training, and more specifically, relating to apparatus and methods for training persons in the sport of golf.

The game of golf is well known. There are many existing methods of instruction and various related equipment available. However, there are disadvantages (identified and discussed throughout) to existing apparatus and methods. As will be demonstrated, the present invention overcomes these disadvantages while achieving various other objects and advantages.

A system and method is presented whereby a student may be trained in the sport of golf using a hand held device. Incorporating associated instructions enhances the effectiveness. A color code system incorporated into a hand held device that helps train the student to develop a correct golf swing. Additionally, the invention is sufficiently weighted such that repeated motion in the prescribed manner results in development of key muscles and coordination necessary for swinging a golf club. Moreover, the weight and configuration of the apparatus helps the user to fully appreciate and experience the centrifugal forces of a golf club swing.

A general knowledge of the game of golf combined with various lessons relating to the golf swing, although not essential, facilitate use of the present invention. Such knowledge is important, but the training is not complete until the student understands how to use the hand held device as used in various motion exercises. Five basic motion exercises are developed. Seven basic positions are necessary for improvement of the golf swing.

BRIEF DESCRIPTION OF THE DRAWINGS

FIG. 1 depicts a plan view of the apparatus

FIG. 1A depicts a fragmentary front view of the apparatus

FIG. 2 depicts a plan view of overlay decal

REFERENCE NUMERALS IN DRAWINGS

Figure 3:
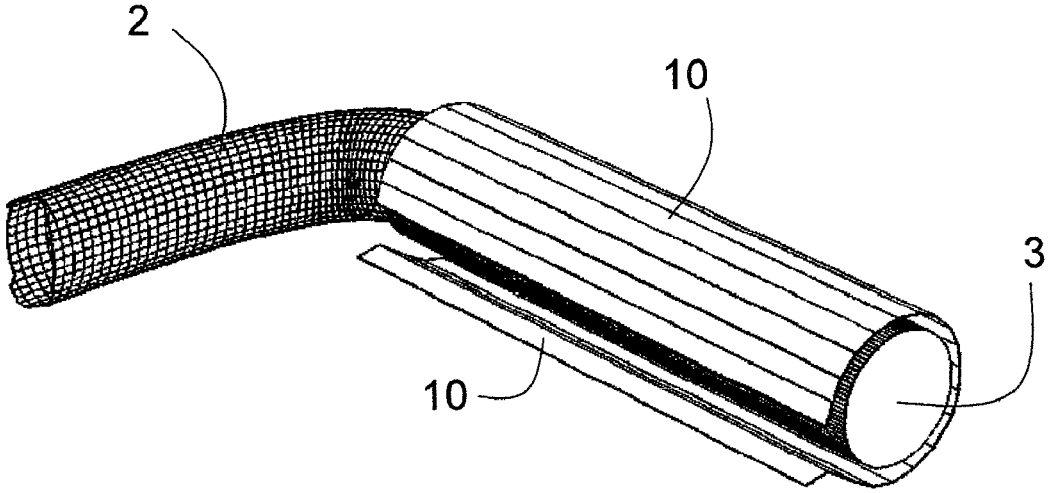
FIG. 3 depicts a fragmentary, exploded, perspective view of the apparatus

The table below lists the reference numerals employed in the figures, and identifies the element designated by each numeral.

| | |
|---|---|
| 1 | standard training grip 1 |
| 2 | grip section 2 |
| 3 | weight bar 3 |
| 10 | overlay decal 10 |
| 11 | first green portion 11 |
| 12 | second green portion 12 |
| 13 | red portion 13 |
| 14 | yellow portion 14 |
| 15 | first edge 15 of overlay decal |
| 16 | first transition 16 |
| 17 | second transition 17 |
| 10A | overlay decal 10A of an alternate embodiment |
| 11A | first green portion 11A of an alternate embodiment |
| 12A | second green portion 12A of an alternate embodiment |
| 13A | red portion 13A of an alternate embodiment |
| 14A | yellow portion 14A of an alternate embodiment |
| 16A | second transition 16A of an alternate embodiment |
| 17A | second transition 17A of an alternate embodiment |
| 20A | base member 20A of an alternate embodiment |
| 21A | first portion 21A of base member of an alternate embodiment |
| 22A | second portion 22A of base member of an alternate embodiment |
| 31A | first color region 31A of second portion of an alternate embodiment |
| 32A | second color region 32A of second portion of an alternate embodiment |
| 33A | third color region 33A of second portion of an alternate embodiment |

DETAILED DESCRIPTION

One embodiment of the present invention (FIGS. 1-3) comprises a weight bar 3, a grip section 2, a standard training grip 1, and an overlay decal 10.

The entire assembly weighs approximately 2.8 pounds. This weight is preferred but not essential. Other weights can be used without compromising the primary function of the invention of utilizing distinct color coded regions to train a user to swing a golf club.

The weight bar 3 is elongated, rigid, and of substantially of 3¼ inches in cross-sectional circumference, substantially 10 inches long, and weighs substantially 2 pounds. It is preferably made from solid steel, but other materials may be used provided they have similar strength and weight characteristics.

The grip section 2 is elongated, rigid, and preferably between 0.58 and 0.60 inches in cross-sectional diameter and substantially 13 inches in length. It is preferably made from steel tubing, but other materials may be used provided they have similar strength and weight characteristics.

In one embodiment, grip section 2 and weight bar 3 have substantially circular cross section. However, other shapes may be used provided the spirit of the invention is not compromised. For instance, a rectangular cross section can be employed such that each facet of the outer periphery comprises a separate color region.

Grip section 2 and weight bar 3 are substantially perpendicular to each other. As depicted in FIG. 1, the connection between them is a rounded connection (an arcuate transition region). However, other configurations may be used (e.g. right angle).

As will be apparent to those of skill in the art, grip section 2 and weight bar 3 can be two separate pieces or one piece bent to achieve the desired angle. The preferred embodiment depicted in FIG. 1 is achieved using the latter method.

The foregoing illustrates a preferred embodiment. However, the length, weight, and cross sectional area of the grip section and weight bar can be varied. As will be appreciated by those of skill in the art, the physical characteristics are adapted to reasonably simulate the swing of an actual golf club (the apparatus weighs more than a typical golf club). Accordingly, the physical characteristics can be altered to suit users of different sizes, etc. without compromising the spirit of the invention.

The overlay decal 10 comprises a first green portion 11, red portion 13, yellow portion 14, and second green portion 12. First transition 16 comprises the border line between first green portion 11 and red portion 13. Second transition 17 comprises the border line between second green portion 12 and yellow portion 14.

Overlay decal 10 is substantially 8⅞ inches wide by 3⅝ inches high. The width, while preferred, can be varied without compromising the effectiveness of the color regions. First green portion 11 is substantially 8⅞ inches wide by ⅜ inches high. Red portion 13 is substantially 8⅞ inches wide by ¾ inches high. Yellow portion 14 is substantially 8⅞ inches wide by 1¼ inches high. Second green portion 12 is substantially 8⅞ inches wide by 1¼ inches high.

Overlay decal 10 is fixedly secured (adhered) to weight bar 3 such that the colored portions of overlay decal 10 face outward and such that first and second transitions 16, 17 are substantially aligned as depicted in FIG. 1A. First edge 15 of overlay decal 10 overlaps first green portion 11 to an extent determined by the cross-sectional diameter of weight bar 3. In this configuration, a user holding the apparatus in the starting position and looking straight down sees equal portions of yellow and green.

The purpose of overlay decal 10 is to impose distinct color regions about the periphery of weight bar 3. Accordingly, other methods of imposing the color regions can be used. For example, the colored regions can be painted directly on. Additionally, it will be apparent to those of skill in the art that other color combinations can be used.

The standard training grip 1 is of a conventional type. It must be capable of fitting over and being securedly fastened to grip section 2 and aligned in such as way as to cause the foregoing color alignment to be achieved.

The standard training grip is preferred but not necessary. It is preferred that some type of grip be used, but the device can be used without a grip. The standard training grip is used because it causes the user to use a conventional golf grip. Other types of grips can be used such as a standard grip found on most golf clubs, or a rubber overlay.

Figure 4:
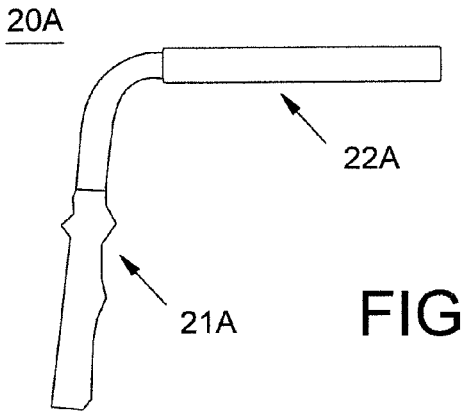
FIG. 4 depicts a plan view of the apparatus of an alternative embodiment
Figure 5:
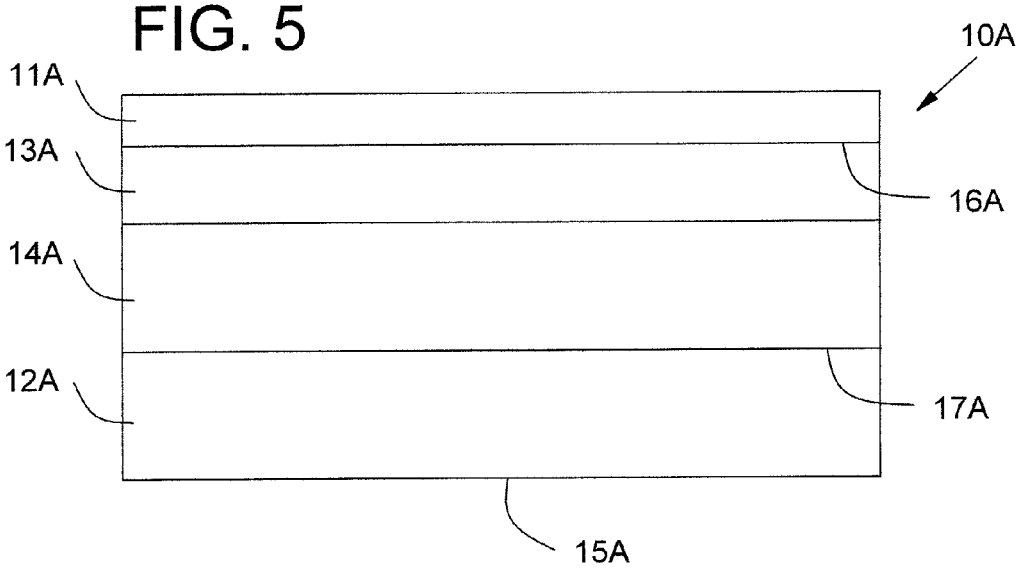
FIG. 5 depicts a plan view of overlay decal of an alternative embodiment
Figure 6:
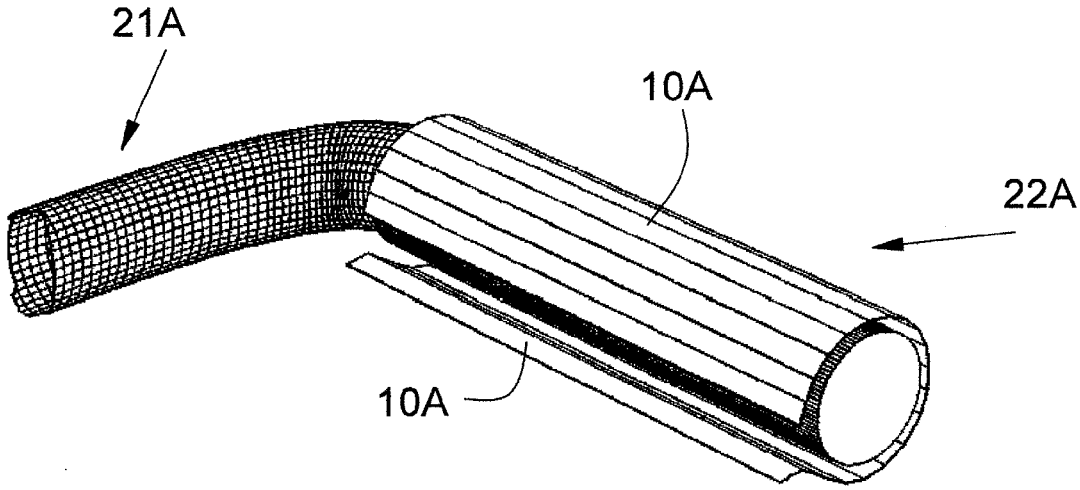
FIG. 6 depicts a fragmentary, exploded, perspective view of the apparatus of an alternative embodiment

One embodiment (FIGS. 4-6) comprises a method for golf swing instruction comprising the steps of: providing a base member 20A having first and second elongated, rigid, portions 21A, 22A, the first portion 21A being adapted to be gripped by a user, the second portion 22A being disposed substantially perpendicular to the first portion 21A, the second portion 22A having first, second, and third distinct color regions 31A, 32A, & 33A about the periphery thereof; directing a user to assume a golf stance, gripping the first portion 21A as the user would grip a golf club, such that the second portion 22A of the base member extends outwardly from the user, and such that equal portions of the first and second color regions 31A, 32A are visible to the user, the third color region 33A not being visible to the user; and prescribing to the user a series of motions to swing the base member 20A in a golf like manner such that only the first and second color regions 31A, 32A will be visible to the user throughout, and only a deviation from the prescribed series of motions will cause the user to see the third color region 33A.

Figure 7A:
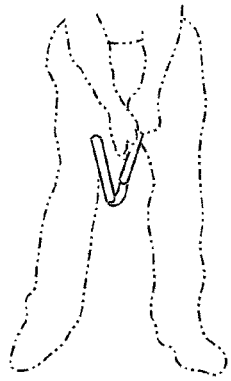
FIG. 7A depicts the starting position (front view) of a series of movements of an alternative embodiment
Figure 7B:
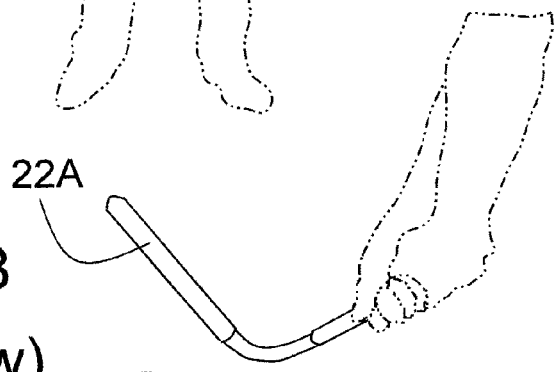
FIG. 7B depicts the starting position (enlarged side view) of a series of movements of an alternative embodiment
Figure 7C:
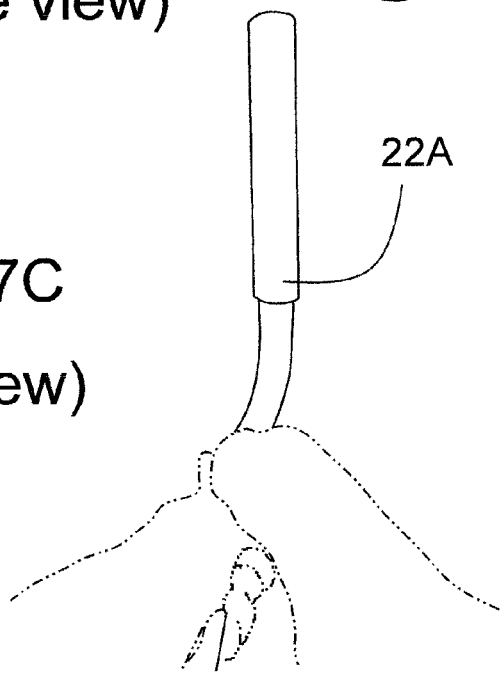
FIG. 7C depicts the starting position (enlarged top view) of a series of movements of an alternative embodiment
Figure 8C:
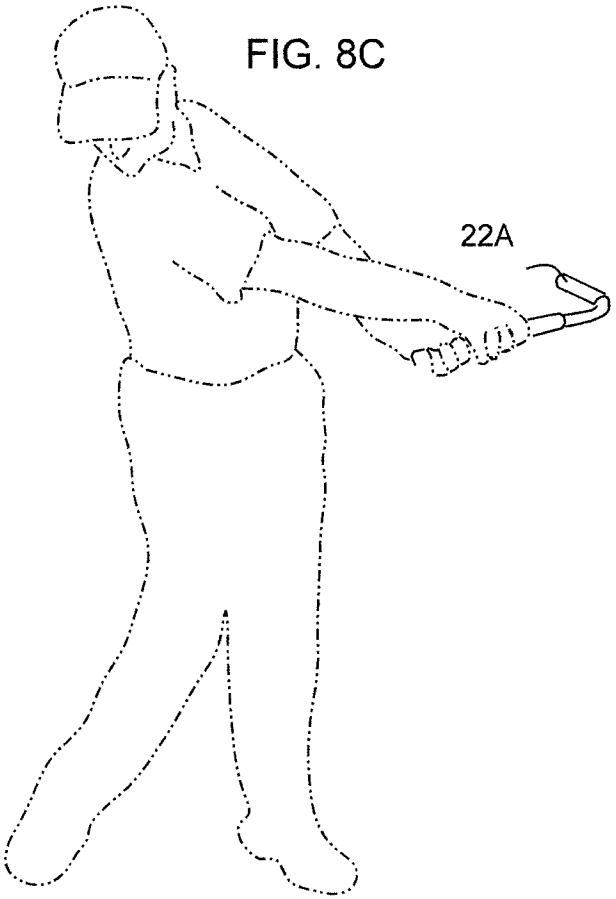
FIG. 8C depicts the follow through of a series of movements of an alternative embodiment
Figure 8B:
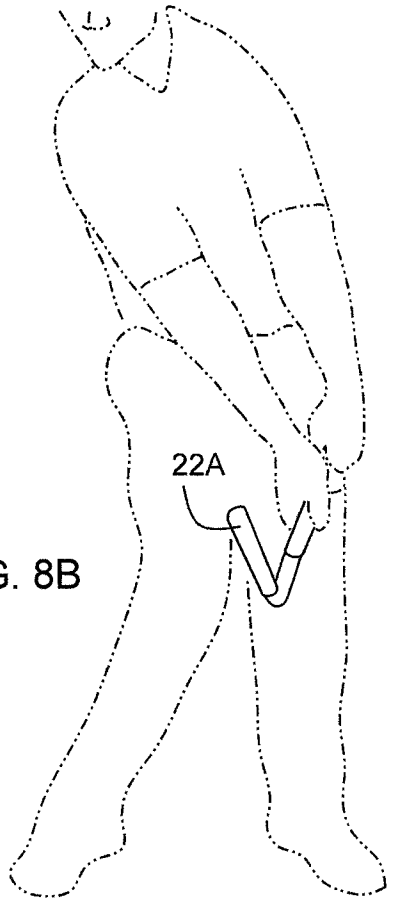
FIG. 8B depicts the impact position of a series of movements of an alternative embodiment
Figure 8A:
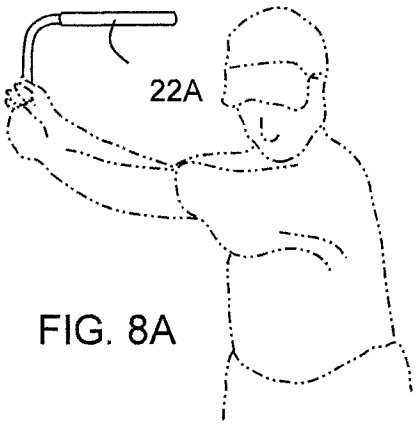
FIG. 8A depicts the backswing of a series of movements of an alternative embodiment

In one embodiment (FIGS. 7,8), the prescribed series of motions comprises the starting position (FIGS. 7A,B,C), where the user sees equal amounts of the first and second color regions 31A, 32A; the backswing, where the user sees only the first color region 31A at the end of the backswing (FIG. 8A); the downswing, where the user sees more of the first color region 31A than the second color region 32A; the impact position (FIG. 8B), where the user sees more of the second color region 32A than the first color region 31A; and the follow-through, where the user sees only the second color region 32A at the end of the follow-through (FIG. 8C).

As will be apparent to golfers, the head should always be down throughout a conventional golf swing so as to look directly at the ball position; and that to use the invention, the user may turn to look at the color regions for diagnostic purposes throughout the swing.

The 3 distinct color regions correspond to overlay decal 10A, the dimensions thereof are the same as overlay decal 10 depicted in FIG. 2. The first color region 31A corresponds to yellow portion 14A. The second color region 32A corresponds to first and second green portions 11A, 12A (overlapped when displaced on second portion 22A). The third color region 33A corresponds to red portion 13A. As will be apparent, different color combinations can be used.

Figure 4A:
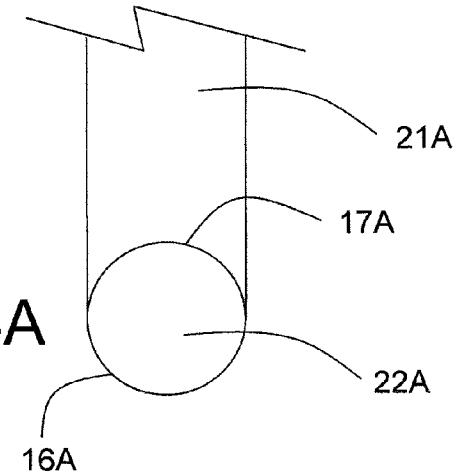
FIG. 4A depicts a fragmentary front view of the apparatus of an alternative embodiment

Second transition 17A comprises the border line between second green portion 12A and yellow portion 14A. Overlay decal 10A is applied to second portion 22A of base member 20A such that first and second transitions 16A, 17A are substantially aligned as depicted in FIG. 4A.

What is claimed is:

1. An apparatus for golf instruction comprising:

a weight bar;

a grip section;

a standard training grip being adapted to fit over the grip section;

and an overlay decal;

the apparatus weighing substantially 2.8 pounds;

the grip section and weight bar having substantially circular cross section;

the weight bar being elongated, rigid, and of substantially of 3¼ inches in cross-sectional circumference, substantially 10 inches long, and weighing substantially 2 pounds;

the grip section being elongated, rigid, and substantially 0.6 inches in cross-sectional diameter and substantially 13 inches in length;

the grip section and weight bar being substantially perpendicular to each other and connected by an arcuate transition portion;

the overlay decal comprising, a first green portion, a red portion, a yellow portion, and a second green portion;

the overlay decal being substantially 8⅞ inches wide by 3⅝ inches high;

the first green portion being substantially 8⅞ inches wide by ⅜ inches high;

the red portion being substantially 8⅞ inches wide by ¾ inches high;

the yellow portion being substantially 8⅞ inches wide by 1¼ inches high;

the second green portion being substantially 8⅞ inches wide by 1¼ inches high;

the overlay decal being adhered to the outer surface of the weight bar such that the first and second green portions overlap.

2. An apparatus for golf instruction comprising:

a weight bar;

a grip section;

the weight bar having distinct color regions about the periphery thereof;

the weight bar and grip sections being elongated and rigid;

the grip section and weight bar being substantially perpendicular to each other;

the distinct color regions about the periphery of the weight bar comprising an overlay decal having, a first green portion, a red portion, a yellow portion, and a second green portion;

the overlay decal being substantially 8⅞ inches wide by 3⅝ inches high;

the first green portion being substantially 8⅞ inches wide by ⅜ inches high;

the red portion being substantially 8⅞ inches wide by ¾ inches high;

the yellow portion being substantially 8⅞ inches wide by 1¼ inches high;

the second green portion being substantially 8⅞ inches wide by 1¼ inches high.

* * * * *